US005897059A

United States Patent [19]

Müller

[11] Patent Number: 5,897,059

[45] Date of Patent: Apr. 27, 1999

[54] NOZZLE FOR USE IN A TORCH HEAD OF A PLASMA TORCH APPARATUS

[75] Inventor: Markus Müller, Dintikon, Switzerland

[73] Assignee: Sulzer Metco AG, Wohlen, Switzerland

[21] Appl. No.: 08/763,713

[22] Filed: Dec. 13, 1996

[51] Int. Cl.[6] ..... B05B 15/00

[52] U.S. Cl. ..... 239/132.3; 239/132; 219/121.48; 219/121.5

[58] Field of Search ..... 239/79, 81, 85, 239/132, 132.1, 132.3, 132.5; 219/76.16, 121.47, 121.48, 121.5

[56] References Cited

U.S. PATENT DOCUMENTS

| | | | |
|---|---|---|---|
| 2,286,192 | 6/1942 | Aitchison et al. | 239/132.5 X |
| 2,327,496 | 8/1943 | Burch | 239/132.5 X |
| 2,327,498 | 8/1943 | Burch | 239/132.5 X |
| 2,828,956 | 4/1958 | Bieniosek et al. | 239/132.3 |
| 3,674,978 | 7/1972 | Becker et al. | 219/121.48 X |
| 3,790,742 | 2/1974 | Auer | 219/121.48 X |
| 4,430,546 | 2/1984 | Irons et al. | 239/132.3 X |
| 4,445,021 | 4/1984 | Irons et al. | 239/132.3 X |
| 4,661,682 | 4/1987 | Gruner et al. . | |
| 5,455,401 | 10/1995 | Dumais et al. | 219/121.48 |

*Primary Examiner*—Andres Kashnikow
*Assistant Examiner*—Steven J. Ganey
*Attorney, Agent, or Firm*—Tarolli, Sundheim, Covell, Tummino & Szabo

[57] ABSTRACT

A nozzle for the head of a plasma torch comprises a central aperture and is provided with a plurality of cooling channels uniformly distributed around the central longitudinal axis of the nozzle in a polar configuration. Each of the cooling channels comprises a first cooling channel portion and a second cooling channel portion communicating with the first one and enclosing an angle between each other. The first cooling channel portions extend radially towards the central longitudinal axis of the nozzle and at least approximately perpendicularly thereto. The second cooling channel portions extend under an acute angle with respect to the central longitudinal axis. By this design, a substantially more uniform and more effective cooling of the nozzle is achieved, with the result that the useful working life is prolonged.

5 Claims, 1 Drawing Sheet

NOZZLE FOR USE IN A TORCH HEAD OF A PLASMA TORCH APPARATUS

FIELD OF THE INVENTION

The present invention refers to a nozzle for use in the torch head of a plasma torch apparatus, comprising at least one cooling channel as well as a central aperture which has an inlet opening and an outlet opening, whereby the central opening tapers from the inlet opening to the outlet opening.

PRIOR ART

Nozzles for use in the torch head of a plasma torch apparatus, i.e. a so-called plasma gun, are known in the prior art in a wide variety of designs and constructions. Such nozzles, on the one hand, serve for concentrating the plasma stream in a desired manner and, on the other hand, take on the task of the anode in the sense that an electric arc required for creating the plasma stream is generated between the nozzle and a cathode located in a certain distance from the nozzle.

In the document EP 0,171,793, a plasma spraying apparatus for applying interior coatings is disclosed which comprises a cooled electrode and a cooled nozzle. Both the electrode and the nozzle are provided with an annular cooling channel through which a cooling medium flows.

Even if such a plasma gun has proven more or less reliable in practical operation, there is an attempt simultaneously to decrease the physical size of the plasma gun and to increase its spraying performance. However, in order to meet these requirements, it is imperative to substantially increase the cooling power in the plasma gun head and particularly in the region of its outlet nozzle. With the designs and constructions of nozzles for plasma guns as known at present in the prior art, this requirement cannot be met at all or, at least, not in the desired extent, because the heat dissipation or removal of the known conventional nozzles is not sufficient to substantially increase the spraying performance required today and in future. Practical tests have shown that the useful working life of such nozzles is dramatically reduced as soon as the spraying performance is substantially increased.

The same is true in connection with a decrease of the size of the plasma gun head. Assuming that the spraying performance has to be kept constant, a decrease of the physical size of the plasma gun head is problematic because the specific heat load of the outlet nozzle thereby increases.

OBJECTS OF THE INVENTION

Thus, it is an object of the invention to provide a nozzle for use in the torch head of a plasma torch apparatus which has a longer useful working life, under identical operating conditions, than nozzles known in the prior art.

It is a further object of the invention to provide a nozzle for use in the torch head of a plasma torch apparatus which enables one to reach an increased spraying power, whereby the useful working life is the same as with nozzles known in the prior art.

It is a still further object of the invention to provide a nozzle for use in the torch head of a plasma torch apparatus which can be easily and reliably fixed in the head of a plasma gun.

SUMMARY OF THE INVENTION

In order to meet these and other objects, the present invention provides a nozzle for use in the torch head of a plasma torch apparatus which comprises a nozzle body of essentially cylindrical configuration and an aperture running through the nozzle body. This aperture is located coaxially to the central longitudinal axis of the nozzle body and has an inlet end and an outlet end. The aperture tapers from the inlet end to the outlet end.

A plurality of cooling channels run through the interior of the nozzle body and are arranged symmetrically around the central longitudinal axis of the nozzle body. Each of the cooling channels comprises a first cooling channel portion and a second cooling channel portion communicating with the first cooling channel portion. These two cooling channel portions enclose an angle between each other.

The first cooling channel portions enter the nozzle body immediately behind a circumferential collar protruding from the outside wall of the nozzle body and being located close to the outlet end of the central aperture. The first cooling channel portions extend radially towards the interior of the nozzle body and essentially perpendicularly to the central longitudinal axis. The second cooling channel portions extend in such a direction that they enclose an acute angle with the central longitudinal axis, whereby the second cooling channel portions open to the outside wall of the nozzle body in the region of the inlet end of the central aperture.

Such a design ensures a substantially increased heat removal as compared to nozzles known in the prior art. In other words, by such a design, a substantially improved and more uniform cooling of the nozzle can be achieved. Due to the provision of a circumferential collar protruding from the outside wall of the nozzle body and being located close to the outlet end of the central aperture and the characteristic, that the first cooling channel portions enter the nozzle body immediately behind that circumferential collar, it can be ensured that the nozzle can be easily inserted into the plasma gun head and reliably fixed and positioned therein. Moreover, such a collar favors a reliable sealing of the cooling channels.

In a preferred embodiment, the design is such that the second cooling channel portions essentially follow the contour of the wall of the tapered central aperture. Thanks to this characteristic, the nozzle is uniformly cooled as seen over its cross section, with the result that the useful working life is further increased.

BRIEF DESCRIPTION OF THE DRAWINGS

In the following, an embodiment of the nozzle according to the invention will be further described, with reference to the accompanying drawings, in which.

DETAILED DESCRIPTION OF THE PREFERRED EMBODIMENT

Figure 1:
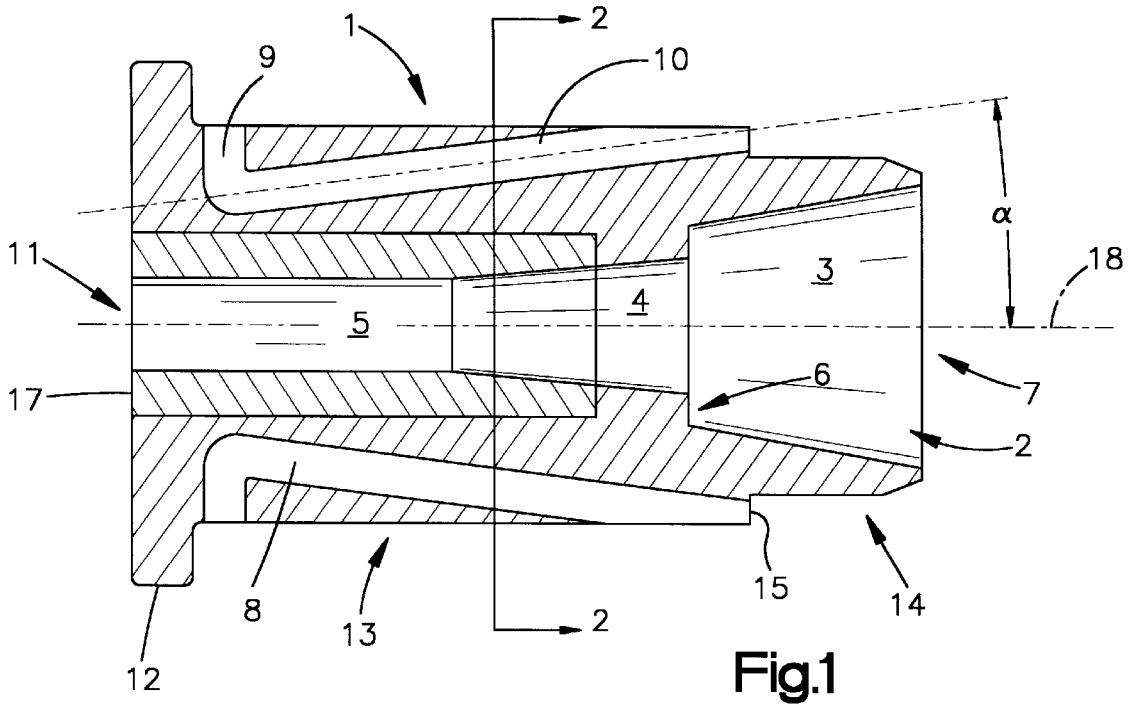
FIG. 1 shows a longitudinal sectional view of an embodiment of the nozzle according to the invention.
Figure 2:
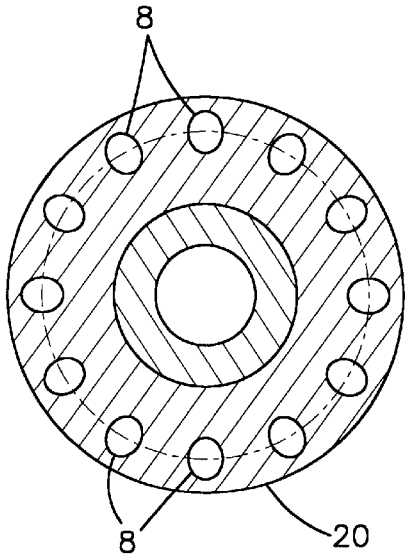
FIG. 2 shows a cross sectional view of the nozzle shown in FIG. 1, taken along the line A—A in FIG. 1.

FIG. 1 shows a sectional view of the nozzle 1 taken along the central longitudinal axis 18 thereof, while FIG. 2 shows a cross sectional view of the nozzle 1 taken along the line A—A. The nozzle 1 has an essentially cylindrical base shape and is provided with a central aperture 2 as well as with a plurality of cooling channels 8 located around the central longitudinal axis 18 of the nozzle 1 in a polar configuration. The expression "polar configuration" shall be understood such that the cooling channels 8 are arranged, as seen in a cross sectional view of the nozzle 1, along the periphery of a circle 20 which is concentric to the central longitudinal axis 18 and evenly distributed along that circle 20. This can be seen particularly clearly in FIG. 2.

The central aperture 2 of the nozzle 1 comprises a first conical portion 3, a second conical portion 4 and a cylindrical portion 5. The first conical portion 3 constitutes the inlet region 7 of the nozzle 1, while the cylindrical portion 5 constitutes the outlet region 11 of the nozzle 1. Due to the provision of the first and second conical portions 3 and 4, respectively, the central aperture 2 of the nozzle 1 tapers from the inlet region 7 towards the outlet region 11 of the nozzle 1.

The first conical portion 3 is shaped, as far as its diameter is concerned, and compared to the shape and diameter, respectively, of the second conical portion, such that a shoulder 6 in the form of an annular surface is constituted at the transition from the first conical portion 3 to the second conical portion 4. This shoulder 6 is effective, during the operation of the nozzle 1, as a damming zone for the gas which is required for the operation of the plasma torch.

Preferably, the nozzle 1 is made of copper or a copper alloy and is provided with a sleeve 17 inserted into the nozzle body and being of essentially cylindrical shape and made e.g. of tungsten. The sleeve 17 is provided with an central aperture by means of which a part of the second conical portion 4 and the entire cylindrical portion 5 of the nozzle 1 is constituted. This tungsten sleeve 17 reduces the metal loss which is caused by the plasma torch starting or ending at the nozzle 1 during operation of the plasma torch in which the nozzle 1 is used. It is understood that the tungsten sleeve could be designed such that it extends through the entire nozzle 1.

The design of the exterior of the nozzle 1 can be described as follows:

In the region of the outlet end 11 of the nozzle 1, there is provided a circumferential, protruding collar 12 having essentially annular shape. Adjacent thereto, an essentially cylindrical central portion 13 is provided. Finally, adjacent to that cylindrical central portion 13, the nozzle 1 comprises an inlet portion 14 located in the region of the inlet region 7 of the nozzle 1. The diameter of the inlet portion 14 is less than the diameter of the central portion 13, with the result that an annular surface 15 is formed between the inlet portion 14 and the central portion 13.

The annular collar 12 serves as a stop member when the nozzle 1 is inserted into a plasma torch. However, the collar 12 and particularly its front rim can be used for fixing the nozzle 1, e.g. by the provision of a fixing member (not shown), for example in the form of a union nut which engages the nozzle 1 at the outer edge of the collar 12. Furthermore, the collar 12 improves the sealing of the cooling channels 8. According to a further embodiment not shown in the drawings, that region of the exterior wall of the nozzle 1 in which the portions 9 of the cooling channels 8 open to the exterior could be provided with an annular channel in the form of peripheral groove in the body of the nozzle 1.

Each cooling channel 8 of the plurality of cooling channels is constituted by a first cooling channel portion 9 and a second cooling channel portion 10. The first and second cooling channel portions 9 and 10, respectively, communicate with each other and extend under an angle relative to each other. The present embodiment shown in the drawings comprises a total of twelve cooling channels 8. The first cooling channel portions 9 extend immediately behind the circumferential collar 12 in radial direction, i.e. in a direction perpendicular to the central longitudinal axis 18, towards the interior of the nozzle 1, while the second cooling channel portions 10 extend under an acute angle $\alpha$ with respect to the central longitudinal axis 18 from the inner ends of the first cooling channels 9 through the interior of the nozzle 1 towards the annular surface 6 and open to the exterior of the nozzle 1 essentially in that region.

The angle $\alpha$ enclosed between the extension of the second cooling channel portions 10 and the central longitudinal axis 18 of the nozzle 1 preferably is chosen such that the second cooling channel portions 10 essentially follow the contour line determined by the dimensions of the particular portions 3, 4 and 5 of the central aperture 2. Such a design of the cooling channels 8, moreover, has the advantage, that they can be created during manufacturing very easily, for example by a drilling operation. The first cooling channel portions 9 preferably extend, as seen in a longitudinal sectional view of the nozzle 1, at least approximately perpendicularly to the central longitudinal axis 18 of the nozzle 1 toward the center of the nozzle 1. The expression "at least approximately perpendicularly" shall be understood in the present case that a tolerance of ±10% is allowable.

The design of the nozzle 1, particularly the design and location of the cooling channels 8, as herein before described, ensures an efficient and uniform cooling of the nozzle 1. Particularly, this can be attributed, amongst else, to the fact that the cooling channels 8 running through the nozzle 1 comprise a substantially larger cooling surface as compared with nozzles for plasma torches known in the prior art. Due to the fact that the second cooling channel portions 10 essentially follow the contour line determined by the dimensions of the particular portions 3, 4 and 5 of the central aperture 2, a uniform temperature distribution throughout the interior of the nozzle body is ensured. The expression "follow the contour line" shall be understood such that the acute angle $\alpha$ enclosed between the extension of the second cooling channel portions 10 and the central longitudinal axis 18 of the nozzle 1 preferably is chosen such that the radially measured distance between the second cooling channel portion 10 and the wall of the central aperture 2 remains more or less constant or, in other words, varies only within narrow limits.

These measures, as explained herein before, particularly taken together, substantially increase the working life of the nozzle 1, as compared to a nozzle known in the prior art and under identical operating conditions.

The cooling medium required for the cooling of the nozzle 1, for instance water, preferably enters the nozzle 1 through the first cooling channel portions 9 and leaves the nozzle 1 through the second cooling channel portions 10. Such a direction of flow of the cooling medium has the advantage that the cooling medium enters the nozzle 1 in the hottest region thereof, as a result of which the best cooling performance is ensured.

It should be understood that the embodiment of the nozzle 1 described herein before represents only one of various possibilities of realization within the scope of the appended claims. Particularly, the number of the cooling channels 8 and their particular way through the nozzle 1 could be changed or adapted to particular operating conditions of the nozzle 1, whereby these modifications shall not be considered as final.

What is claimed is:

1. A nozzle for use in a torch head of a plasma torch apparatus, comprising:

a nozzle body of essentially cylindrical configuration having an outside wall and a central longitudinal axis;

an aperture running through said nozzle body and being located coaxially with said central longitudinal axis, said aperture having an inlet end and an outlet end and said aperture tapering from said inlet end to said outlet end;

a circumferential collar protruding from said outside wall of said nozzle body and being located close to said outlet end of said central aperture;

a plurality of cooling channels running through the interior of said nozzle body and being arranged symmetrically around said central longitudinal axis;

each of said cooling channels comprising a first cooling channel portion extending in a first direction, and a second cooling channel portion extending in a second direction and communicating with said first cooling portion, said first and second directions enclosing an angle of less than 90° between each other;

said first cooling channel portions extending through said outside wall and entering said nozzle body immediately behind said circumferential collar and said first direction extending radially towards the interior of said nozzle body essentially perpendicularly to said central longitudinal axis; and said second direction in which said second cooling channel portions extend enclosing an acute angle with said central longitudinal axis, whereby said second cooling channel portions open to said outside wall of said nozzle body in the region of said inlet end of said central aperture;

said nozzle body comprising a central portion of essentially cylindrical configuration and an end portion of essentially cylindrical configuration, said end portion being located in the region of said inlet end of said central aperture and having an outer diameter which is less than the outer diameter of said central portion, such that an annular surface is created in which said second cooling channel portions open to the outside of said nozzle body.

2. A nozzle according to claim 1 in which said nozzle body comprises a sleeve member inserted into said nozzle body and extending coaxially with said central longitudinal axis, said sleeve member extending from said outlet end of said central aperture along at least a part of the longitudinal extension of said nozzle body.

3. A nozzle according to claim 2 in which said sleeve member is made of a high-melting material, preferably of tungsten.

4. A nozzle according to claim 1 in which said nozzle body is made of copper or of a copper alloy.

5. A nozzle according to claim 1, comprising at least eight and preferably twelve cooling channels.

* * * * *